US007353828B1

(12) United States Patent
Hirshberg

(10) Patent No.: US 7,353,828 B1
(45) Date of Patent: Apr. 8, 2008

(54) DOUBLE QUICK RELEASE MOUTH GUARD ASSEMBLY

(75) Inventor: Jonathan Hirshberg, Manhattan Beach, CA (US)

(73) Assignee: JR286 Technologies, Inc., Redondo Beach, CA (US)

( * ) Notice: Subject to any disclaimer, the term of this patent is extended or adjusted under 35 U.S.C. 154(b) by 232 days.

(21) Appl. No.: 11/288,488

(22) Filed: Nov. 28, 2005

(51) Int. Cl.
*A61C 5/14* (2006.01)

(52) U.S. Cl. ..... 128/861; 128/859

(58) Field of Classification Search ..... 128/848, 128/859, 861, 862; 433/6
See application file for complete search history.

(56) References Cited

U.S. PATENT DOCUMENTS 3,485,242 A * 12/1969 Greenberg ..... 128/862
5,174,564 A * 12/1992 Young, III ..... 473/458
5,365,946 A * 11/1994 McMillan ..... 128/861
6,941,952 B1 * 9/2005 Rush, III ..... 128/861

* cited by examiner

*Primary Examiner*—Patricia Bianco
*Assistant Examiner*—Camtu Nguyen
(74) *Attorney, Agent, or Firm*—Thomas I. Rozsa

(57) ABSTRACT

The present invention is a mouth guard which is worn to protect a person's teeth when the person is engaged in a sports activity such as football. A strap which has a quick release mating member at each end interconnects the mouth guard with a bar on a helmet worn by the person. One quick release mating member is removably connected to a bar on the helmet and the other quick release mating member is removably connected to a receiving member in the mouth guard. In the event of a collision between participants in the sport which results in the helmet flying off the person's head, one or both of the quick release members will disengage the strap from either the bar on the helmet, the mouth guard, or both to thereby avoid damage to the person's teeth.

10 Claims, 10 Drawing Sheets

DOUBLE QUICK RELEASE MOUTH GUARD ASSEMBLY

BACKGROUND OF THE INVENTION

1. Field of the Invention

The present invention relates to the field of devices which protect an athlete's teeth while the athlete is engaged in a sporting activity such as playing football.

2. Description of the Prior Art

In general, there are many devices known in the prior art which are used to protect an athlete or a person while the athlete or person is engaged in a sporting activity. In one sporting activity such as football, the person engaged in playing football wears many protective devices to protect various body parts of the person such as shoulder pads, leg guards, and a helmet which has bars in front to protect the person's face during physical contact while playing football.

One of the most sensitive parts of a person's body are the person's teeth. There frequently are violent collisions between persons engaged in the game of football, such as a running back being tackled by a defensive player or a wide receiver being hit by a defensive player. During these collisions, it is very easy for one or more teeth to be knocked out or otherwise damaged such as being chipped or cracked. To help protect teeth and reduce the occurrence of damage to teeth, devices such as mouth guards have been developed. In the prior art, one type of mouth guard is a dental tray which is conformed to the shaped of a person's upper teeth and is worn in the mouth to protect the upper teeth. The mouth guard rests against the person's lower teeth to also protect the person's lower teeth. Many mouth guards are separate pieces which are taken out of the person's mouth after a play is run and either carried in the person's hand or pressed into a portion of the helmet worn by the person and is then reinserted into the mouth immediately prior to the beginning of the next play. One problem with a hand held mouth guard is that holding it in the person's hand or retaining it on the person's helmet leads to many germs coming in contact with the mouth guard which is then placed into a person's mouth where the germs come in direct contact with the person's teeth ands gums and can create an infection and disease in the person.

To avoid the above problem, mouth guards have been designed which are attached to a strap. The strap is attached to the mouth guard at one end and attached to a bar of the football helmet at the other end. This design eliminates the problem of having to carry the mouth guard in the person's hand or squeezing it into a portion of the helmet because the person does not have to carry the mouth guard after a play and the mouth guard hangs down from the strap. However, while solving one problem, this strap design presents a possibly even greater problem. During the violent collisions which occur when football is played, a person's helmet can be knocked off. With the strap attached to a bar of the helmet and to the mouth guard, when the helmet is knocked off the person's head, the strap and mouth guard are forced to travel with the helmet. Since the mouth guard is carried in the person's mouth during this activity, there is a significant risk that when the mouth guard and strap go flying with the football helmet, the person's teeth can be severely damaged or knocked out.

Therefore, there is a significant need for a mouth guard which protects a person's teeth and eliminates the problem of having to carry the mouth guard in the person's hand between football plays and at the same time reduces the problem associated with a mouth guard attached to a strap and a football helmet where a person's teeth can be knocked out if the helmet goes flying off the person's head during a collision.

SUMMARY OF THE INVENTION

The present invention is a mouth guard which is worn to protect a person's teeth when the person is engaged in a sports activity such as football. A strap which has a quick release mating member at each end interconnects the mouth guard with a bar on a helmet worn by the person. One quick release mating member is removably connected to a bar on the helmet and the other quick release mating member is removably connected to a receiving member in the mouth guard. In the event of a collision between participants in the sport which results in the helmet flying off the person's head, one or both of the quick release members will disengage the strap from either the bar on the helmet, the mouth guard, or both to thereby avoid damage to the person's teeth.

It has been discovered, according to the present invention, that for a mouth guard which is connected by a strap to a bar on a football helmet, in order to prevent injury to a person's teeth, it is necessary to provide means to either disengage the mouth guard from the strap or disengage the strap from the football helmet during a collision which results in the football helmet flying off the person's head.

It has also been discovered, according to the present invention, that if a connecting strap has a quick release engagement member such as a clip at one end which is removably received into a mating receiving member in the mouth guard and the strap is connected at its opposite end to a protective helmet, then in the event of a collision during a sporting event where the helmet is caused to be removed from a person's head, the quick release engagement member will disengage from the receiving member in the mouth guard so that the mouth guard remains in the person's mouth and thereby prevents injury to the person's teeth.

It has further been discovered, according to the present invention, that if a connecting strap has a quick release engagement member such as an engagement clip at one end which is removably received onto to portion of a protective helmet such as a face bar and the strap is connected at its opposite end to a mouth guard, then in the event of a collision during a sporting event where the helmet is caused to be removed from a person's head, the quick release engagement clip will disengage from the portion of the helmet to which it is attached so that the mouth guard remains in the person's mouth and thereby prevents injury to the person's teeth.

It has also been discovered, according to the present invention, that if a connecting strap has a quick release engagement member at one end which is removably received into a mating receiving member in the mouth guard and the opposite end the strap has a quick release engagement member which is removably received onto to portion of a protective helmet such as a face bar, then in the event of a collision during a sporting event where the helmet is caused to be removed from a person's head, either the quick release engagement member at one end of the strap will disengage from the mouth guard, or the quick release engagement member at the opposite end of the strap will disengage from the helmet, or both quick release engagement members will respectively disengage from the mouth guard and the helmet so that the mouth guard remains in the person's mouth and thereby prevents injury to the person's teeth.

It has also been discovered, according to the present invention, that if the quick release engagement member at the end of the strap connected to the helmet has a widened surface, then a logo or other decoration can be placed on the surface of the quick release engagement member.

It has additionally been discovered, according to the present invention, that if the quick release engagement member received in the mouth guard has a widened surface connected to the engagement member at the location opposite to where it is received within the mouth guard, a decorative logo or other decoration can be placed on the surface so that the mouth guard is not connected to any strap but instead has a decorative element in addition to a protective element.

It has also been discovered, according to the present invention, that if the mouth guard has a quick release engagement cavity which extends through the entire width of the mouth guard, then when the clip is not inserted, the cavity provides a breathing hole for the user when the mouth guard is held between the user's teeth. In addition, if there is at least one additional opening extending through the mouth guard, then a breathing hole is formed in the mouth guard even when the clip is inserted into the cavity in the mouth guard.

It has further been discovered, according to the present invention, that if the mouth guard has attached at its front end a transversely extending female clip member which can be removably attached to a potion of a protective helmet such as a face mask bar, then if the mouth guard is used by itself without an attaching strap, after a play is over the player can removably attach the mouth guard to a face mask bar while the next play is being called and in this way the mouth guard does not have to be held in the player's hand and the mouth guard will not be lost between plays. When the next play is called, the mouth guard is once again inserted into the player's mouth and held between the player's teeth. The female connecting means will not interfere with the user's ability to play football as the protruding female attaching means extends only for a short distance in front of the mouth guard and does not come in contact with a face mask bar during a play.

It is therefore an object of the present invention to prevent injury to a person's teeth from a mouth guard which is connected by a strap to a bar on a football helmet by providing means to either disengage the mouth guard from the strap or disengage the strap from the football helmet during a collision which results in the football helmet flying off the person's head.

It is also an object of the present invention to prevent injury to a person's teeth from a mouth guard connected to one end of a strap and at the opposite end the strap is connected to a protective helmet, by incorporating a quick release engagement member such as a clip at one end of the strap which is removably received into a mating receiving member in the mouth guard and the strap is connected at its opposite end to a protective helmet, so that in the event of a collision during a sporting event where the helmet is caused to be removed from a person's head, the quick release engagement member will disengage from the receiving member in the mouth guard so that the mouth guard remains in the person's mouth and thereby prevents injury to the person's teeth.

It is further an object of the present invention to prevent injury to a person's teeth from a mouth guard connected to one end of a strap and at the opposite end the strap is connected to a protective helmet, by incorporating a quick release engagement member such as a clip at one end of the strap which is removably connected to a portion of a protective helmet so that in the event of a collision during a sporting event where the helmet is caused to be removed from a person's head, the quick release engagement clip will disengage from the portion of the helmet to which it is attached so that the mouth guard remains in the person's mouth and thereby prevents injury to the person's teeth.

It is additionally an object of the present invention to prevent injury to a person's teeth from a mouth guard connected to one end of a strap and at the opposite end the strap is connected to a protective helmet, by incorporating a quick release engagement member such as a clip at one end of the strap which is removably received into a mating receiving member in the mouth guard and incorporating a quick release engagement member at the opposite end of the strap which is removably received onto to portion of a protective helmet such as a face bar, so that in the event of a collision during a sporting event where the helmet is caused to be removed from a person's head, either the quick release engagement member at one end of the strap will disengage from the mouth guard, or the quick release engagement member at the opposite end of the strap will disengage from the helmet, or both quick release engagement members will respectively disengage from the mouth guard and the helmet so that the mouth guard remains in the person's mouth and thereby prevents injury to the person's teeth.

It is another object of the present invention to provide a widened surface on the quick release engagement member at the end of the strap connected to the helmet so that a logo or other decoration can be placed on the surface of the quick release engagement member.

It is an additional object of the present invention to provide a widened surface on the quick release engagement member which is received in the mouth guard so that a decorative logo or other decoration can be placed on the surface so that the mouth guard is not connected to any strap but instead has a decorative element in addition to being a protective element.

It is also an object of the present invention to provide a mouth guard having a quick release engagement cavity which extends through the entire width of the mouth guard, so that when the clip is not inserted, the cavity provides a breathing hole for the user when the mouth guard is held between the user's teeth. In addition, if there is at least one additional opening extending through the mouth guard, then a breathing hole is formed in the mouth guard even when the clip is inserted into the cavity in the mouth guard.

It is a further object of the present invention to provide a mouth guard which has attached at its front end a transversely extending female clip member which can be removably attached to a potion of a protective helmet such as a face mask bar, so that if the mouth guard is used by itself without an attaching strap, after a play is over the player can removably attach the mouth guard to a face mask bar while the next play is being called and in this way the mouth guard does not have to be held in the player's hand and the mouth guard will not be lost between plays. When the next play is called, the mouth guard is once again inserted into the player's mouth and held between the player's teeth. The female connecting means will not interfere with the user's ability to play football as the protruding female attaching means extends only for a short distance in front of the mouth guard and does not come in contact with a face mask bar during a play.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Figure 1:
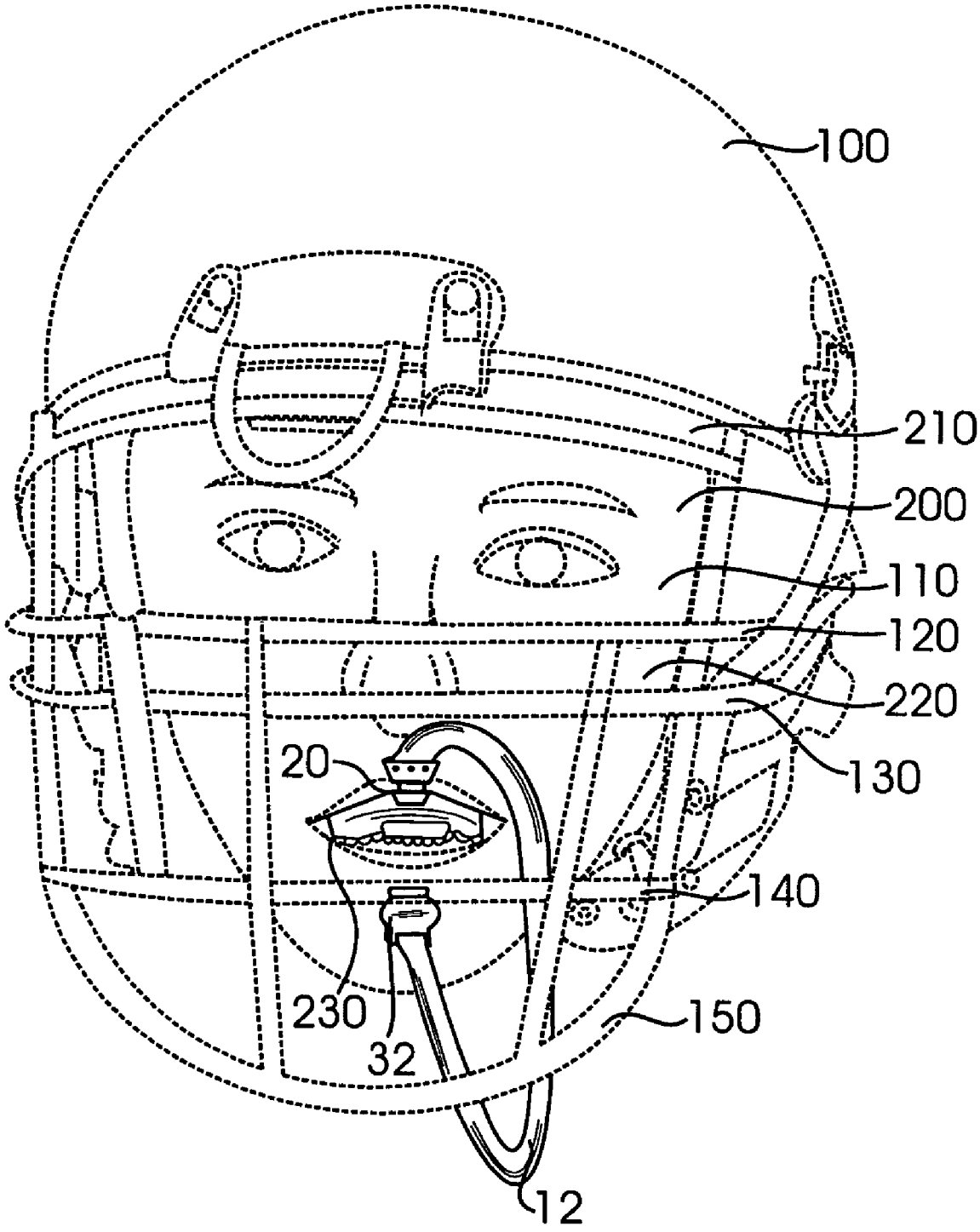
FIG. 1 is a perspective view of a person wearing a protective helmet and illustrating the present invention double quick release mouth guard assembly with the mouth guard in the person's mouth and with a strap interconnecting the quick release mechanisms with one quick release engagement member removably received in the mouth guard and the second quick release engagement member removably connected to a face bar on the protective helmet.
Figure 2:
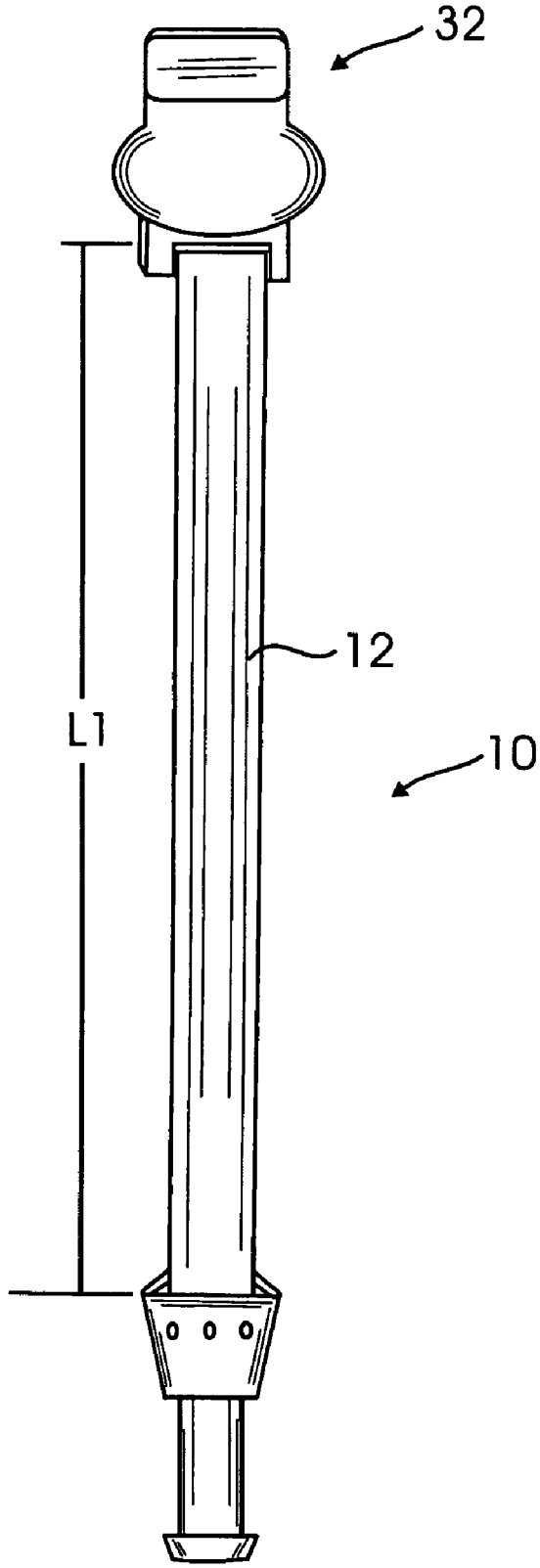
FIG. 2 is a top plan view of a strap with a quick release engagement member which will be received in a mouth guard at one end of the strap and a quick release engagement member which will be removably attached to a portion of a protective helmet at the other end of the strap.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIGS. 2 through 10, there is illustrated the present invention double quick release mouth guard assembly 10. The assembly includes an elongated interconnecting strap member 12 have a first end 14 and a second end 16. By way of example only, the strap member 10 can have a length "L" of approximately 145 millimeters and can be made out of flexible material such as nylon webbing.

Attached to the first end 14 of strap member 12 is a first quick release engagement member 20 which is comprised of a male clip member 22 having a generally elongated shaped upper sidewall 24 and a generally widened frustum shaped end 26 with lips 26A which extend to either side of the sidewall 24, both sidewalls terminating in a flat leading edge 28. Spaced apart from the male clip member 22 is a stop collar 30. By way of example, the length "L2" of the male clip member 22 can be approximately 12.5 millimeters.

Figure 7:
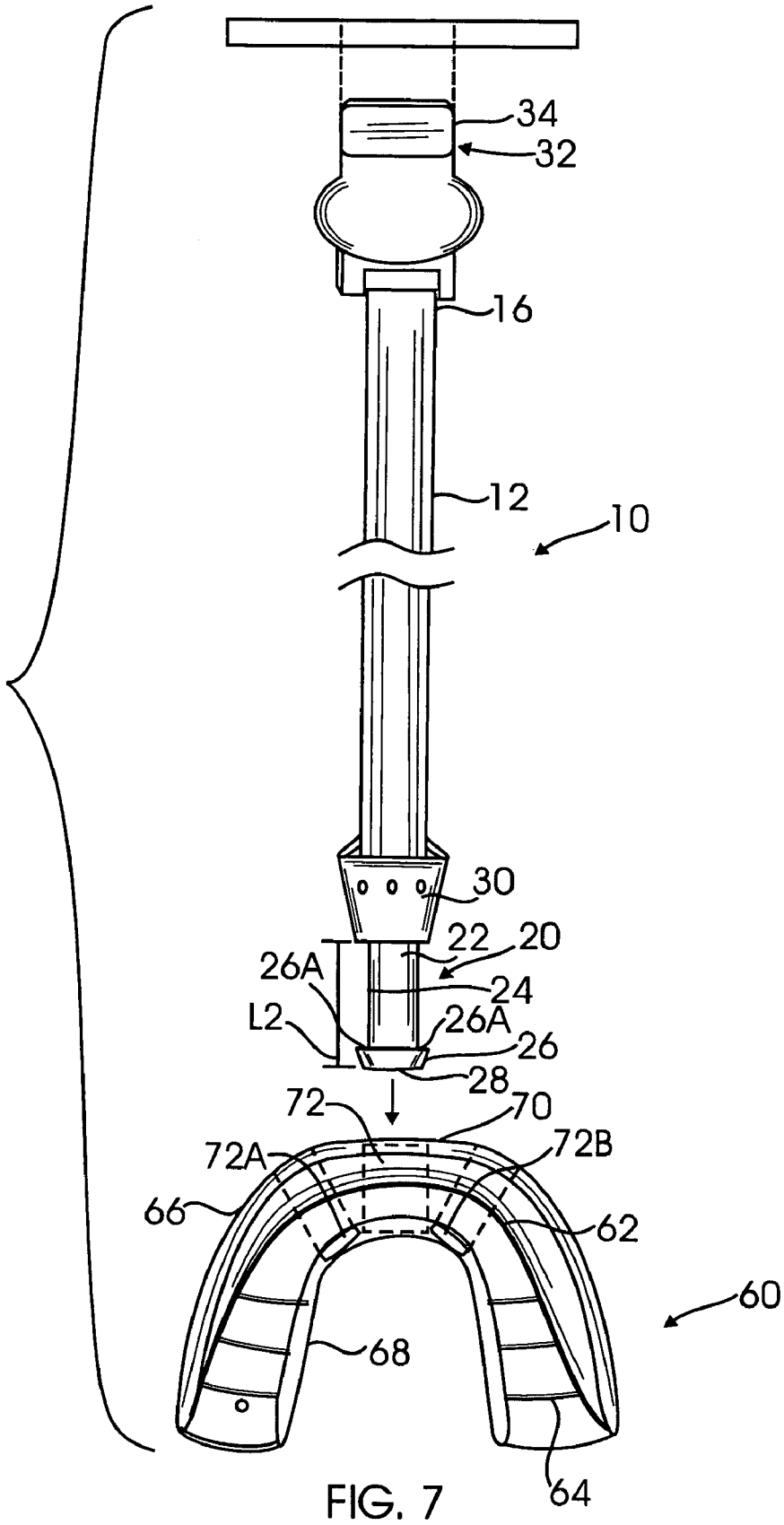
FIG. 7 is an exploded view showing the quick release engagement member removed from a bar of a face mask of a helmet and a quick release engagement member removed from a receiving member of a mouth guard.
Figure 8:
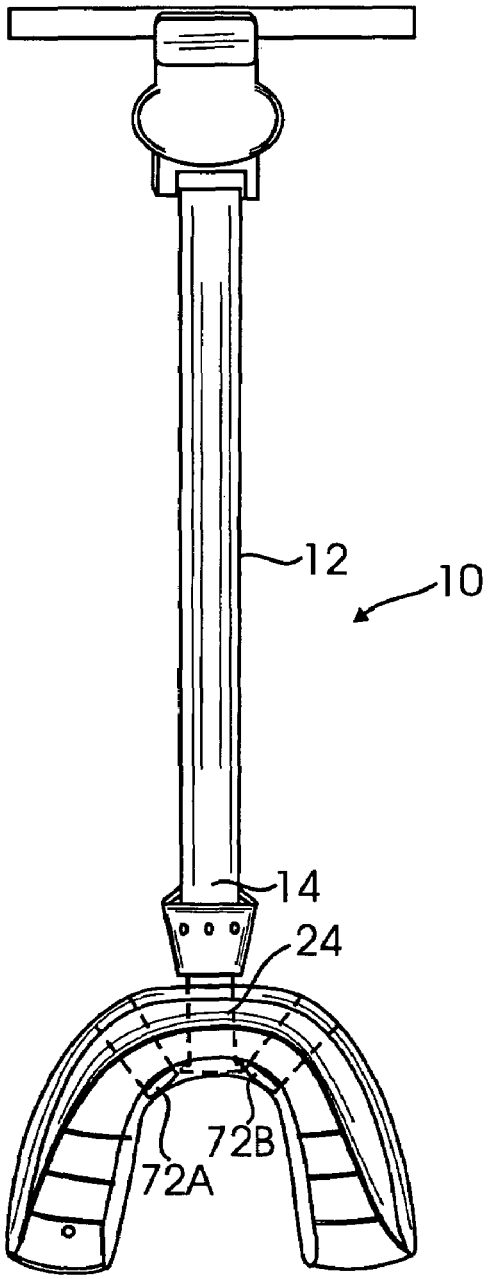
FIG. 8 is a top plan view of the present invention double quick release mouth guard assembly with one quick release engagement member removably received within a mouth guard and one quick release engagement member removably received on a face mask bar of a helmet.
Figure 9:
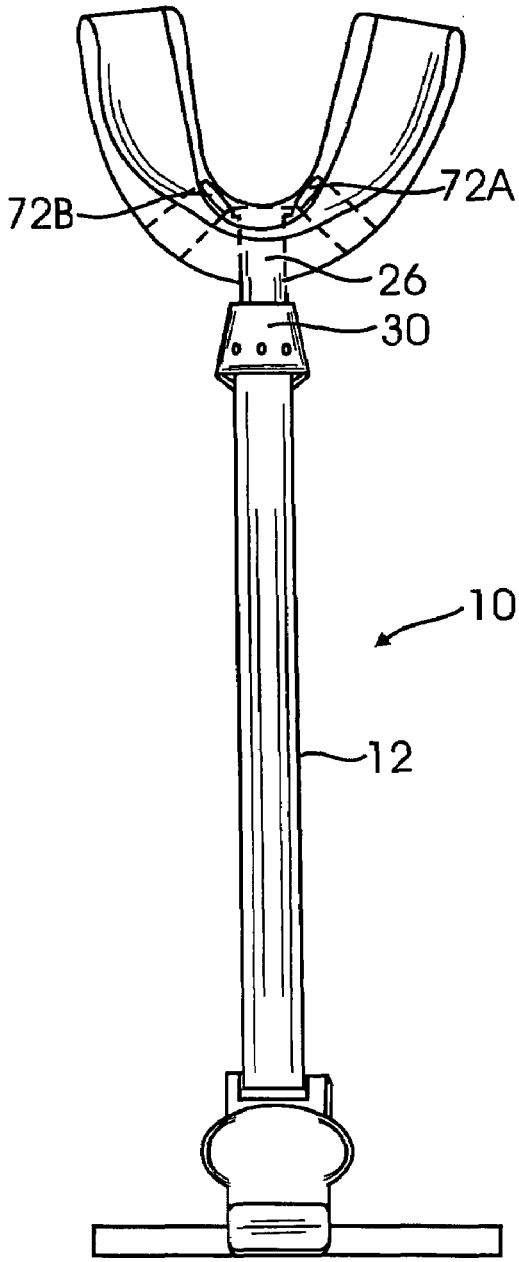
FIG. 9 is a bottom plan view of the present invention double quick release mouth guard assembly with one quick release engagement member removably received within a mouth guard and one quick release engagement member removably received on a face mask bar of a helmet.
Figure 10:
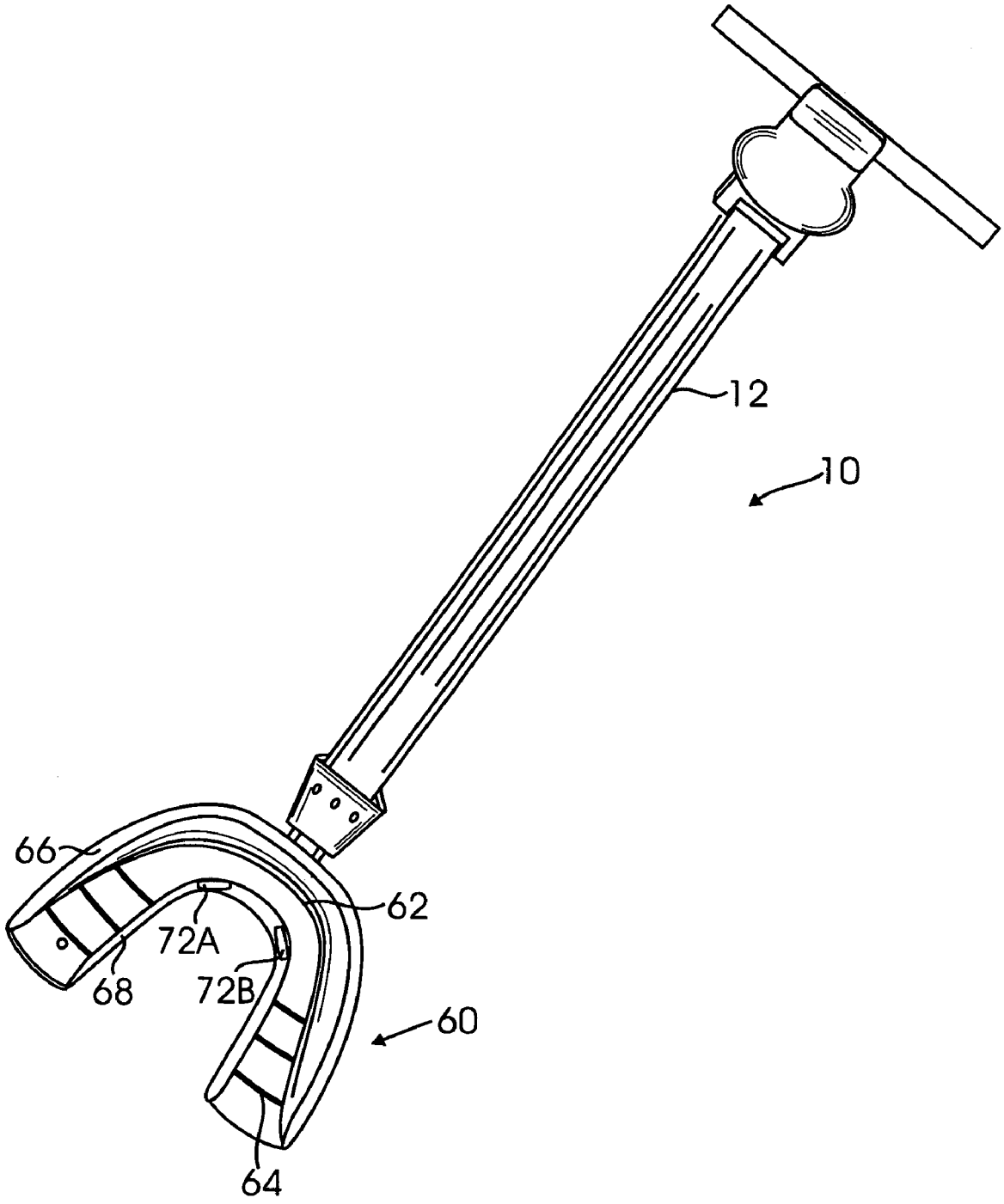
FIG. 10 is a top perspective view of the present invention double quick release mouth guard assembly with one quick release engagement member removably received within a mouth guard and one quick release engagement member removably received on a face mask bar of a helmet.

Referring particularly to FIGS. 7 and 10, a mouth guard 60 has a body 62 having a teeth receiving tray 64 surrounded by a circumferential exterior sidewall 66 and a circumferential interior sidewall 68. In use, the mouth guard 60 is placed into a user's mouth so that the user's teeth rest on receiving tray 64 and are surrounded by circumferential exterior sidewall 66 and circumferential interior sidewall 68. The front 70 of mouth guard 60 has a receiving cavity 72 in the body 62 of the mouth guard 60 at a location below the teeth receiving tray 64, and preferably extending through the entire width of the mouth guard. The shape of the receiving cavity 72 conforms to the shape of the male clip member 22. As best illustrated in FIGS. 7, 8 and 9, the male clip member 22 is inserted into receiving cavity 72 so that the stop collar 30 lies adjacent the front 70 of mouth guard 60 and lips 26A help secure the clip member 22 within the receiving cavity 72. The fit between male clip member 22 and receiving cavity 72, even with the securing lips 26A, is a loose press fit. In the event of a tugging force on the strap 12; the male clip member 22 will immediately come loose from and be pulled out of the receiving cavity 72 in mouth guard 60. When the male clip member 22 is not inserted into the receiving cavity 72, then the receiving cavity provides a breathing opening in the mouth guard. Additional openings 72A and 72B extend through the mouth guard 60 on either side of cavity 72 so that breathing holes are provided even when the clip member 22 is inserted into receiving cavity 72. It is also within the spirit and scope of the present invention to have at least one extra breathing hole 72A or 72B.

Figure 3:
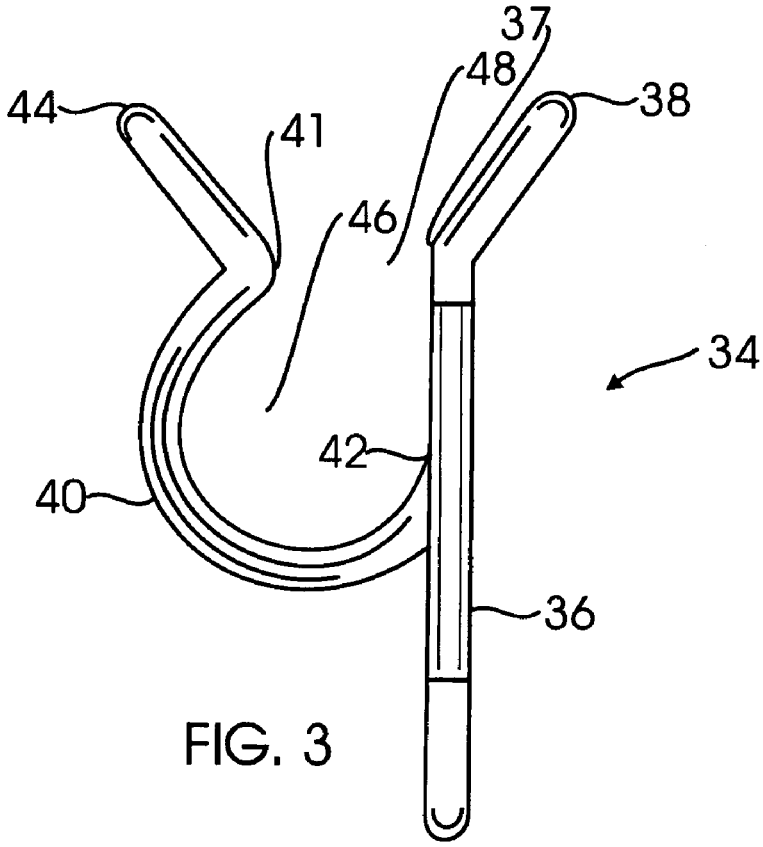
FIG. 3 is a left side elevational view of the quick release engagement member which will be removably attached to a portion of a protective helmet.
Figure 4:
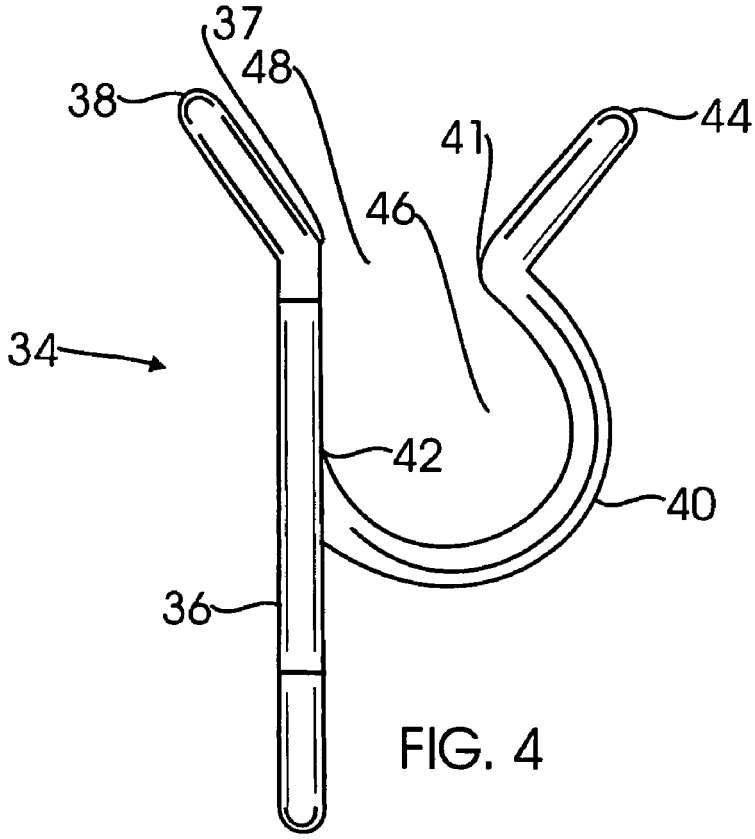
FIG. 4 is a right left side elevational view of the quick release engagement member which will be removably attached to a portion of a protective helmet.

Referring to FIGS. 2, 7, 8, 9 and 10, attached to the second end 16 of strap member 12 is a second quick release engagement member 32 which is comprised of a female clip member 34. As best illustrated in FIGS. 3 and 4 the female clip member 34 has a rear wall 36 terminating in an outwardly extending leading end 38. The rear wall 36 supports rounded wall 40 which extends from the approximate midpoint 42 of rear wall 36 in a generally arcuate fashion for approximately 180 degrees and then extends in an outwardly extending leading end 44 which extends away from outwardly extending leading end 38. The rounded wall 40 defines an interior cavity 46 which is bounded by rear wall 36 and rounded wall 40 with an opening 48 between rear wall 36 and rounded wall 40 and the locations 37 which is the areas where rear wall 34 begins its outwardly extending leading end 36 and the area 41 where the rounded wall 40 begins its outwardly extending leading end 44. The opening or gap 46 is sized to be slightly smaller than a face bar 140 of a protective helmet such as a football helmet 100 so that when the female clip member 34 is pressed against a face bar 140, as illustrated in FIGS. 1, 7, 8, 9 and 10, the face bar snaps into interior cavity 46 and is retained therein. In the event of a tugging action on the strap 12, the face bar 140 will be immediately pulled out of cavity 46 and released from male clip member 34.

Figure 5:
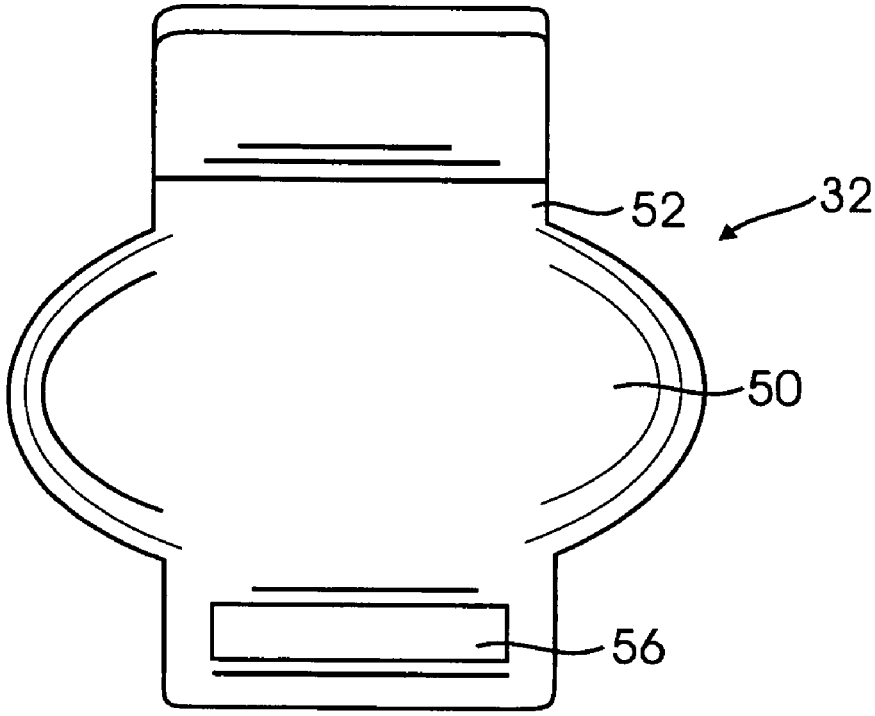
FIG. 5 is a front elevational view of one embodiment of the quick release engagement member which will be removably attached to a portion of a protective helmet showing a widened surface onto which a logo or other decoration can be placed.
Figure 6:
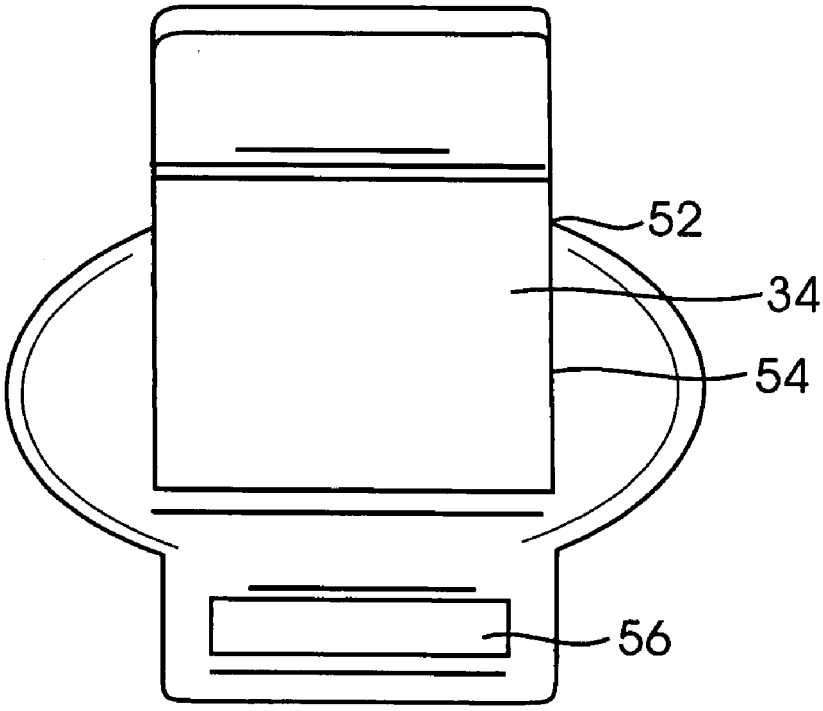
FIG. 6 is a front elevational view of an alternative embodiment of the quick release engagement member which will be removably attached to a portion of a protective helmet.

Referring to FIGS. 5 and 6, the second quick release engagement member 32 can have a widened surface 50 on the body 52 of second quick release engagement member 32 which widened surface 50 extends on the side of rear wall 36 opposite to the wall from which the rounded wall 40 extends so that a logo or other decoration can be placed on widened surface 50 as illustrated in FIG. 5. Alternatively, as illustrated in FIG. 6, the rear wall 36 can occupy most of the surface area 54 of the body 52. At the end opposite the male clip member 34, the body 52 has a receiving slot 56 for receiving the second end 16 of strap 12.

The present invention is illustrated in use in FIG. 1. The helmet 100 which by way of example is a football helmet is worn around a person's head. The person 200 wears the helmet 100 on the person's head 210 so that the person's face 220 can look through the opening 110 in the helmet 100. The helmet 100 includes a multiplicity of protective members such as face bars 120, 130, 140 and 150. The purpose of the face bars is to protect the person's face 220 so that body parts of an opposing player do not contact the person's face 220. When playing a sport, the person opens the person's mouth 230 and places the mouth guard 60 therein so that when the mouth guard 60 is placed into a user's mouth 230, the user's teeth rest on receiving tray 64 and are surrounded by circumferential exterior sidewall 66 and circumferential interior sidewall 68.

The first quick release engagement member 20 is placed into the receiving cavity 72 of mouth guard 60 in the manner previously described and second quick release engagement member 32 is placed onto one of the face mask bars 120, 130 or 140 in the manner previously described with the strap 12 positioned between the person's mouth 230 and the face mask bars 120, 130 and 140 with the strap hanging down below the helmet as illustrated in FIG. 1.

When the person is engaged in a heavy contact sport such as football, violent collisions frequently occur. When such violent collisions occur, the helmet 100 is sometimes knocked off the person's head 210. When the helmet 100 is caused to be removed from the person's head in this violent way, the strap 12 has a tugging force imparted on at least one end 14 or 16 and sometimes on both ends 14 and 16 depending on the nature of the force, the location where the force impacts the helmet 100, etc. If the tugging force on the strap 12 is at the location of the first end 14, the first quick release engagement member 20 is released from the cavity 72 of mouth guard 60 in the manner previously described and the mouth guard 60 remains in the person's mouth while the helmet 100 and strap fly away. If the tugging force on the strap 12 is at the location of the second end 16, the second quick release engagement member 32 is released from the face mask bar 120, 130 or 140 in the manner previously described and the mouth guard 60 remains in the person's mouth while the helmet 100 flies away. The strap 12 is still attached to the mouth guard 60. If the fore is at both locations 14 and 16, both the first quick release engagement member 20 is released from the cavity 72 in the mouth guard 60 and the second quick release engagement member 32 is released from the face mask bar 120, 130, or 140. The mouth guard 60 remains in the person's mouth while the helmet 100 flies way and the strap 12 falls to the ground.

While the first quick release engagement member has been illustrated with a male member 22 inserted into a female cavity 72 in the mouth guard 60, it will be appreciated that it is within the spirit and scope of the present invention for the first quick release engagement member to have a female receiving member with the mouth guard 60 having a male connecting member extending from it. Similarly, the second quick release engagement member can be attached to any part of the helmet 100 and not only to a face mask bar.

Figure 11:
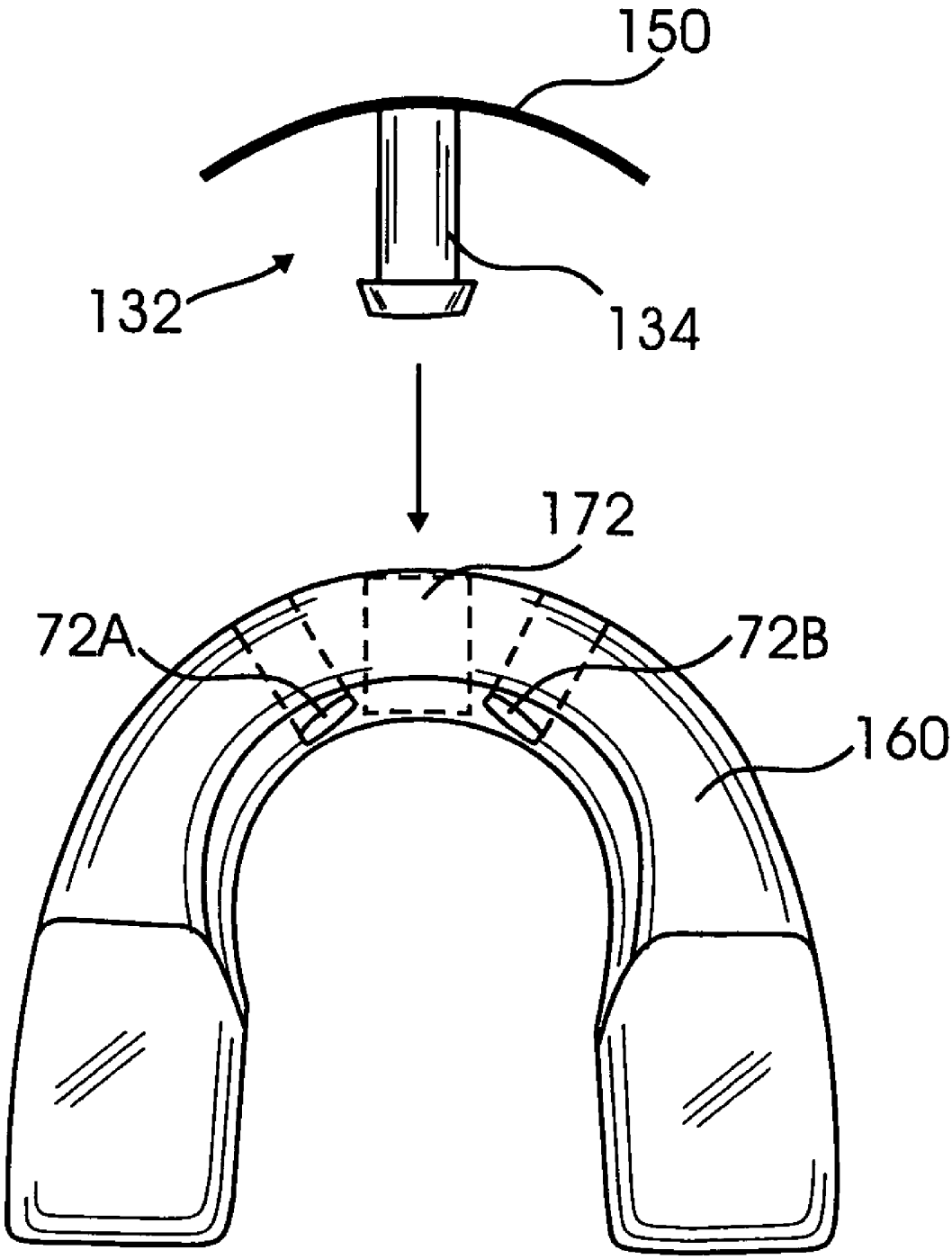
FIG. 11 is an exploded view of an alternative embodiment of the present invention which is a decorative mouth guard.
Figure 12:
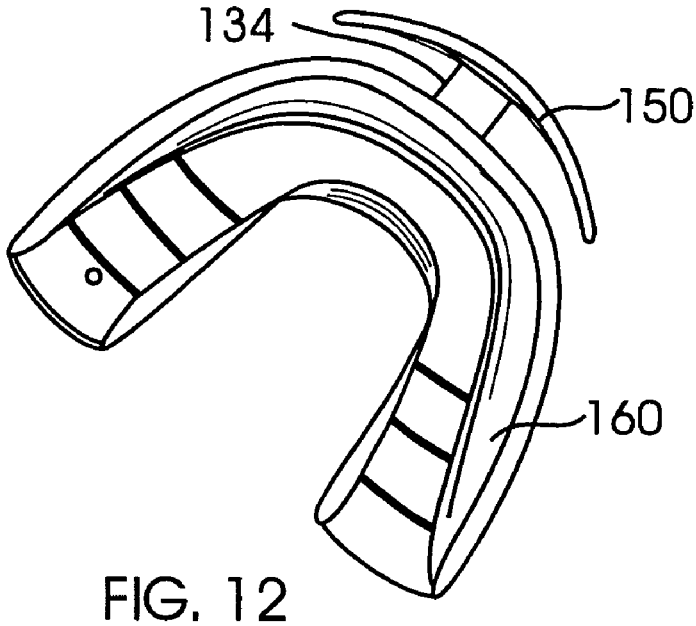
FIG. 12 is a perspective view of an alternative embodiment of the present invention which is a decorative mouth guard.
Figure 13:
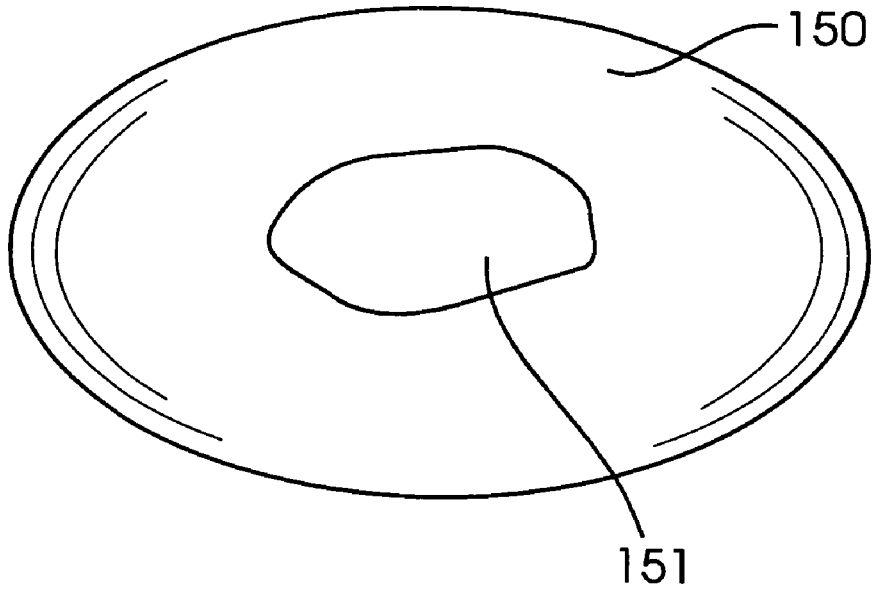
FIG. 13 is a front elevational view of an alternative embodiment of the present invention which is a decorative mouth guard.

In an alternative embodiment of the present invention, the mouth guard 160 is used to protect the person's teeth and functions additionally as a decorative embodiment. Referring to FIGS. 11 through 13, the mouth guard 160 has a receiving cavity 172. An engagement member 132 has at one end male clip member 134 having a shape which conforms to the shape of the receiving cavity 172. Extra breathing holes 172A and 172B are on either side of the receiving cavity 172. At its opposite end, the engagement member 132 has a widened surface area 150 onto which a logo or other decoration 151 can be placed. In its completed assembled condition as illustrated in FIG. 12, the mouth guard 160 is retained in a person's mouth to protect a person's teeth as previously described and the widened surface 150 with decorative logo 151 is in front of the person's mouth to provide a decorative feature to the mouth guard. In this embodiment, the mouth guard 160 protects the person's teeth and serves a decorative function as well. It is not connected to any strap or to a face mask bar.

Figure 14:
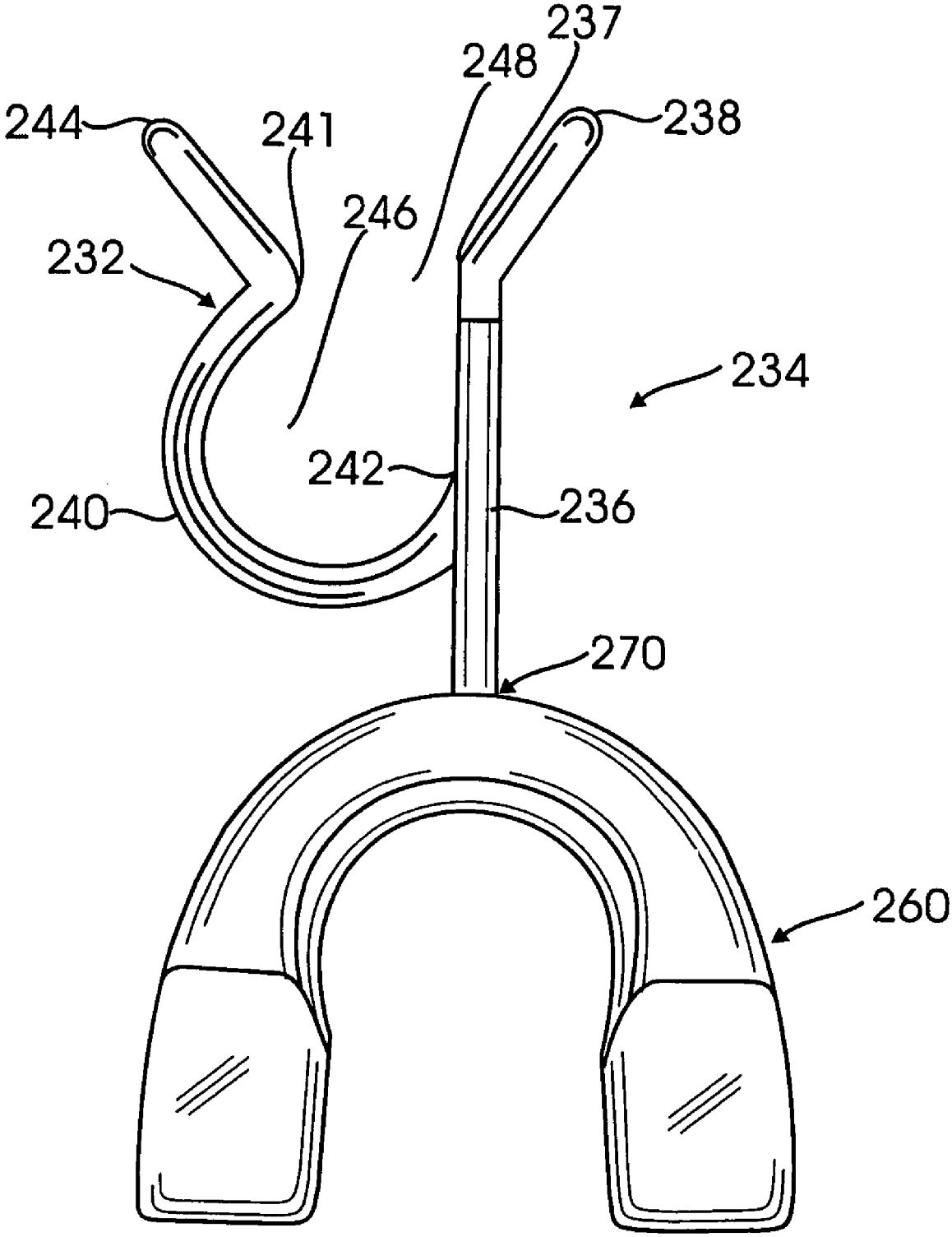
FIG. 14 is a bottom plan view of another alternative embodiment of the present invention which is a mouth guard having an attaching mean such as a female clip member extending from the mouth guard.

In a second alternative embodiment of the present invention, the mouth guard 120 is used to protect a person's teeth and also contains a protruding attaching means 234 which enables the entire mouth guard and attaching means to be removably attached to a portion of a protective helmet such as a face mask bar between plays when the mouth guard is not retained in the user's mouth. Referring to FIG. 14, a second alternative of the mouth guard 160 is shown. The embodiment of the mouth guard 260 has the same internal components of the previous embodiments including a teeth receiving tray surrounded by a circumferential exterior sidewall and a circumferential interior sidewall so that in use, the mouth guard 260 is placed into a user's mouth so that the user's teeth rest on the teeth receiving tray and the teeth are surrounded by the circumferential exterior and interior sidewalls.

The bottom plan view of FIG. 14 shows the attaching means 232 comprised of a female clip member 234. As illustrated in FIG. 14 the female clip member 234 has a rear wall 236 terminating in an outwardly extending leading end 238. The rear wall 236 supports rounded wall 240 which extends from the approximate midpoint 242 of rear wall 236 in a generally arcuate fashion for approximately 180 degrees and then extends in an outwardly extending leading end 244 which extends away from outwardly extending leading end 238. The rounded wall 240 defines an interior cavity 246 which is bounded by rear wall 236 and rounded wall 240 with an opening 248 between rear wall 236 and rounded wall 240 and the locations 237 which is the areas where rear wall 234 begins its outwardly extending leading end 236 and the area 241 where the rounded wall 240 begins its outwardly extending leading end 244. The opening or gap 246 is sized to be slightly smaller than a face bar 140 of a protective helmet such as a football helmet 100 so that when the female clip member 234 is pressed against a face bar 140, as illustrated in FIGS. 1, 7, 8, 9 and 10, the face bar snaps into interior cavity 246 and is retained therein.

As illustrated in FIG. 14, the rear wall 236 has a proximate end 243 which is attached to and preferably molded into the front 270 of the mouth guard 260 so that the female clip member 234 extends transversely to the front of the mouth guard. Through use of this second alternative embodiment of a mouth guard 260, after a play is over the player can removably attach the mouth guard to a face mask bar while the next play is being called and in this way the mouth guard does not have to be held in the player's hand and the mouth guard will not be lost between plays. When the next play is called, the mouth guard is once again inserted into the player's mouth and held between the player's teeth. The female connecting means will not interfere with the user's ability to play football as the protruding female attaching means extends only for a short distance in front of the mouth guard and does not come in contact with a face mask bar during a play.

While shown oriented parallel to the body of the mouth guard, the attaching means 232 can be rotated 90 degrees to the orientation illustrated in FIG. 14.

Defined in detail, the present invention is a mouth guard assembly to be used in conjunction with a protective helmet having at least one face mask bar of a given diameter, the mouth guard assembly comprising: (a) an elongated interconnecting strap member having a first end and a second end; (b) a first quick release engagement member attached to the first end of said interconnecting strap member and comprised of a male clip member having a generally elongated shaped upper sidewall and a generally widened frustum shaped end terminating in a flat leading edge with ends having lips extending from the sidewall, with a stop collar on the interconnecting strap member and spaced apart from and adjacent to the of the end of the male clip member remote from the flat leading edge; (c) said mouth guard having a body having a teeth receiving tray surrounded by a circumferential exterior sidewall and a circumferential interior sidewall, the body having a front portion beneath the teeth receiving tray having a receiving cavity within said body at its front portion, the shape of the receiving cavity conformed to the shape of the male clip member so that when the male clip member is inserted into the receiving cavity, a loose press fit is formed, the mouth guard having at least one additional breathing hole extending through it; (d) a second quick release engagement member attached to the second end of the interconnecting strap and further comprised of a body having means to attached the body to the strap at one end of the strap and a female clip member at the other end of the body, the female clip member having a rear wall terminating in an outwardly extending leading, the rear wall supporting a rounded wall which extends from the approximate midpoint of the rear wall in a generally arcuate fashion and then extends in an outwardly extending leading end which extends away from the outwardly extending leading end of the rear wall, an opening between the rear wall and the rounded wall leading to an interior cavity between the rear wall and the rounded wall, the interior cavity sized to be slightly smaller than the diameter of the face mask bar so that when the female clip member is inserted onto the face mask bar of the helmet there is a loose press fit between the face mask bar and the interior cavity; and (e) the mouth guard assembly worn in a person's mouth while a person wears the helmet on the person's head so that the male clip member of the first quick release engagement member is removably inserted into the receiving cavity of the mouth guard and the interior cavity of the male clip member of the second quick release engagement member is removably attached to the least one face mask bar of the helmet so that in the event of an impact force which causes the helmet to be removed from the person's head, depending on the location on the impact force, the first quick release engagement member will be released from the mouth guard and/or the second quick release engagement member will be released from the face mask bar so that the mouth guard remains in the person's mouth.

Defined broadly, the present invention is a mouth guard assembly to be used in conjunction with a protective helmet having at least one face mask bar of a given diameter, the mouth guard assembly comprising: (a) an elongated interconnecting strap member having a first end and a second end; (b) a first quick release engagement member attached to the first end of the interconnecting strap member and comprised of a male clip member with a stop collar on the interconnecting strap member and spaced apart from the male clip member; (c) the mouth guard having a body having a teeth receiving tray surrounded by a circumferential exterior sidewall and a circumferential interior sidewall, the body having a front portion beneath the teeth receiving tray having a receiving cavity within the body at its front portion, the shape of the receiving cavity conformed to the shape of the male clip member so that when the male clip member is inserted into the receiving cavity, a loose press fit is formed; (d) a second quick release engagement member attached to the second end of the interconnecting strap and further comprised of a body having means to attach the body to the strap at one end of the strap and a female clip member with a receiving interior cavity at the other end of the body, the interior cavity sized to be slightly smaller than the diameter of the face mask bar so that when the female clip member is inserted onto the face mask bar of the helmet there is a loose press fit between the face mask bar and the interior cavity; and (e) the mouth guard assembly worn in a person's mouth while a person wears the helmet on the person's head so that the male clip member of the first quick release engagement member is removably inserted into the receiving cavity of the mouth guard and the interior cavity of the female clip member of the second quick release engagement member is removably attached to the least one face mask bar of the helmet so that in the event of an impact force which causes the helmet to be removed from the person's head, depending on the location on the impact force, the first quick release engagement member will be released from the mouth guard and/or the second quick release engagement member will be released from the face mask bar so that the mouth guard remains in the person's mouth.

Defined more broadly, the present invention is a mouth guard assembly to be used in conjunction with a protective helmet, the mouth guard assembly comprising: (a) an elongated interconnecting strap member having a first end and a second end; (b) a first quick release engagement member attached to the first end of the interconnecting strap member and comprised of a male clip member of a given shape; (c) the mouth guard having a body having teeth receiving means, the body having a front portion beneath the teeth receiving means having a receiving cavity within the body at its front portion, the shape of the receiving cavity conformed to the shape of the male clip member so that when the male clip member is inserted into the receiving cavity, a loose press fit is formed; (d) a second quick release engagement member attached to the second end of the interconnecting strap and further comprised of a body having means to attach the body to the strap at one end of the strap and means to removably attach the second quick release engagement member to a portion of the helmet so that a loose press fit is formed between the attachment means and the helmet and (e) the mouth guard assembly worn in a person's mouth while a person wears the helmet on the person's head so that the male clip member of the first quick release engagement member is removably inserted into the receiving cavity of the mouth guard and the attachment means of the second quick release engagement member is removably attached to a portion of the helmet so that in the event of an impact force which causes the helmet to be removed from the person's head, depending on the location on the impact force, the first quick release engagement member will be released from the mouth guard and/or the second quick release engagement member will be released from the helmet so that the mouth guard remains in the person's mouth.

Defined even more broadly, the present invention is a mouth guard assembly to be used in conjunction with a protective helmet, the mouth guard assembly comprising: (a) an elongated interconnecting strap member having a first end and a second end; (b) a first quick release engagement member attached to the first end of the interconnecting strap member and comprised of a male clip member of a given shape; (c) the mouth guard having a body having teeth receiving means, the body having a front portion beneath the teeth receiving means having a receiving cavity within the body at its front portion, the shape of the receiving cavity conformed to the shape of the male clip member so that when the male clip member is inserted into the receiving cavity, a loose press fit is formed; (d) means to attach the second end of the interconnecting strap to a portion of the helmet; and (e) the mouth guard assembly worn in a person's mouth while a person wears the helmet on the person's head so that the male clip member of the first quick release engagement member is removably inserted into the receiving cavity of the mouth guard and the second end of the interconnecting strap is attached to a portion of the helmet so that in the event of an impact force which causes the helmet to be removed from the person's head, the first quick release engagement member will be released from the mouth guard so that the mouth guard remains in the person's mouth.

Defined even more broadly, the present invention is a mouth guard assembly to be used in conjunction with a protective helmet, the mouth guard assembly comprising: (a) an elongated interconnecting strap member having a first end and a second end; (b) a first quick release engagement member attached to the first end of the interconnecting strap member and having a quick release interconnecting means; (c) the mouth guard having a body having teeth receiving means, the body having a mating quick release interconnecting means so that when the interconnecting means of the first quick release engagement member and the mouth guard are connected, a loose press fit is formed; (d) means to attach the second end of the interconnecting strap to a portion of the helmet; and (e) the mouth guard assembly worn in a person's mouth while a person wears the helmet on the person's head so that the interconnecting means of the first quick release engagement member and interconnecting means the mouth guard are removably interconnected and the second end of the interconnecting strap is attached to a portion of the helmet so that in the event of an impact force which causes the helmet to be removed from the person's head, the first quick release engagement member will be released from the mouth guard so that the mouth guard remains in the person's mouth.

Defined even more broadly, the present invention is a mouth guard assembly to be used in conjunction with a protective helmet, the mouth guard assembly comprising: (a) an elongated interconnecting strap member having a first end and a second end; (b) the mouth guard having a body having teeth receiving means, the body attached to the first end of the interconnecting strap; (c) a quick release engagement member attached to the second end of the interconnecting strap and further comprised of a body having means to attach the body to the strap at the second end of the strap and means to removably attach the second quick release engagement member to a portion of the helmet so that a loose press fit is formed between the attachment means and the helmet; and (d) the mouth guard assembly worn in a person's mouth while a person wears the helmet on the person's head so that the first end of the strap is attached to the mouth guard and the attachment means of the second quick release engagement member is removably attached to a portion of the helmet so that in the event of an impact force which causes the helmet to be removed from the person's head, the quick release engagement member at the second end of the interconnecting strap will be released from the helmet so that the mouth guard remains in the person's mouth.

Defined even more broadly, the present invention is a mouth guard assembly comprising: (a) a first engagement member comprised of a male clip member at one end and a widened surface on the other end; and (b) the mouth guard having a body having a teeth receiving tray surrounded by a circumferential exterior sidewall and a circumferential interior sidewall, the body having a front portion beneath the teeth receiving tray having a receiving cavity within the body at its front portion, the shape of the receiving cavity conformed to the shape of the male clip member so that when the male clip member is inserted into the receiving cavity, a loose press fit is formed.

Defined even more broadly, the present invention is a mouth guard assembly comprising: (a) a first engagement member comprised of a male clip member at one end and a widened surface on the other end; and (b) the mouth guard having a body having a teeth receiving tray, the body having a front portion beneath the teeth receiving tray having a receiving cavity within the body at its front portion, the shape of the receiving cavity conformed to the shape of the male clip member so that the male clip member is inserted into the receiving cavity.

Defined even more broadly, the present invention is a mouth guard assembly comprising: (a) a first engagement member comprised of a first mating means at one end and a widened surface on the other end; and (b) the mouth guard having a body having a teeth receiving tray, the body having a second mating means which is joined to the first mating means so that the widened surface area rests in front of the mouth guard.

Defined alternatively, the present invention is a mouth guard assembly comprising: (a) a mouth guard with a body having a teeth receiving tray and a front edge; and (b) an attaching means attached to the mouth guard and extending transversely to the front edge so that the attaching means can be removably attached to a face mask bar of a protective helmet.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A mouth guard assembly to be used in conjunction with a protective helmet having at least one face mask bar of a given diameter, the mouth guard assembly comprising:

a. an elongated interconnecting strap member having a first end and a second end;

b. a first quick release engagement member attached to the first end of said interconnecting strap member and comprised of a male clip member having a generally elongated shaped upper sidewall and a generally widened frustum shaped end terminating in a flat leading edge with ends having lips extending from the sidewall, with a stop collar on the interconnecting strap member and spaced apart from and adjacent to the of the end of the male clip member remote from the flat leading edge;

c. said mouth guard having a body having a teeth receiving tray surrounded by a circumferential exterior sidewall and a circumferential interior sidewall, the body having a front portion beneath the teeth receiving tray having a receiving cavity within said body at its front portion, the shape of the receiving cavity conformed to the shape of the male clip member so that when the male clip member is inserted into the receiving cavity, a loose press fit is formed, the mouth guard having at least one additional breathing hole extending through it;

d. a second quick release engagement member attached to the second end of the interconnecting strap and further comprised of a body having means to attached the body to the strap at one end of the strap and a female clip member at the other end of the body, the female clip member having a rear wall terminating in an outwardly extending leading, the rear wall supporting a rounded wall which extends from the approximate midpoint of the rear wall in a generally arcuate fashion and then extends in an outwardly extending leading end which extends away from the outwardly extending leading end of the rear wall, an opening between the rear wall and the rounded wall leading to an interior cavity between the rear wall and the rounded wall, the interior cavity sized to be slightly smaller than the diameter of the face mask bar so that when the female clip member is inserted onto the face mask bar of the helmet there is a loose press fit between the face mask bar and the interior cavity; and e. the mouth guard assembly worn in a person's mouth while a person wears the helmet on the person's head so that the male clip member of the first quick release engagement member is removably inserted into the receiving cavity of the mouth guard, and the interior cavity of the female clip member of the second quick release engagement member is removably attached to the least one face mask bar of the helmet so that in the event of an impact force which causes the helmet to be removed from the person's head, depending on the location on the impact force, the first quick release engagement member will be released from the mouth guard and/or the second quick release engagement member will be released from the face mask bar so that the mouth guard remains in the person's mouth.

2. The mouth guard assembly in accordance with claim 1 wherein the rear wall of said second quick release engagement member further comprises a widened surface onto which a decoration can be placed.

3. The mouth guard assembly in accordance with claim 1 wherein the receiving cavity extends through the mouth guard to provide a breathing hole when the male clip member is not inserted therein.

4. A mouth guard assembly to be used in conjunction with a protective helmet having at least one face mask bar of a given diameter, the mouth guard assembly comprising:

a. an elongated interconnecting strap member having a first end and a second end;

b. a first quick release engagement member attached to the first end of said interconnecting strap member and comprised of a male clip member with a stop collar on the interconnecting strap member and spaced apart from the male clip member;

c. said mouth guard having a body having a teeth receiving tray surrounded by a circumferential exterior sidewall and a circumferential interior sidewall, the body having a front portion beneath the teeth receiving tray having a receiving cavity within said body at its front portion, the shape of the receiving cavity conformed to the shape of the male clip member so that when the male clip member is inserted into the receiving cavity, a loose press fit is formed;

d. a second quick release engagement member attached to the second end of the interconnecting strap and further comprised of a body having means to attach the body to the strap at one end of the strap and a female clip member with a receiving interior cavity at the other end of the body, the interior cavity sized to be slightly smaller than the diameter of the face mask bar so that when the female clip member is inserted onto the face mask bar of the helmet there is a loose press fit between the face mask bar and the interior cavity; and e. the mouth guard assembly worn in a person's mouth while a person wears the helmet on the person's head so that the male clip member of the first quick release engagement member is removably inserted into the receiving cavity of the mouth guard, and the interior cavity of the female clip member of the second quick release engagement member is removably attached to the least one face mask bar of the helmet so that in the event of an impact force which causes the helmet to be removed from the person's head, depending on the location on the impact force, the first quick release engagement member will be released from the mouth guard and/or the second quick release engagement member will be released from the face mask bar so that the mouth guard remains in the person's mouth.

5. The mouth guard assembly in accordance with claim 4 wherein the female clip member of said second quick release engagement member further comprises a widened surface onto which a decoration can be placed.

6. The mouth guard assembly in accordance with claim 4, further comprising at least one breathing hole extending through said mouth guard.

7. A mouth guard assembly to be used in conjunction with a protective helmet, the mouth guard assembly comprising:

a. an elongated interconnecting strap member having a first end and a second end;

b. a first quick release engagement member attached to the first end of said interconnecting strap member and comprised of a male clip member of a given shape;

c. said mouth guard having a body having teeth receiving means, the body having a front portion beneath the teeth receiving means having a receiving cavity within said body at its front portion, the shape of the receiving cavity conformed to the shape of the male clip member so that when the male clip member is inserted into the receiving cavity, a loose press fit is formed;

d. a second quick release engagement member attached to the second end of the interconnecting strap and further comprised of a body having means to attach the body to the strap at one end of the strap and means to removably attach the second quick release engagement member to a portion of said helmet so that a loose press fit is formed between the attachment means and the helmet and e. the mouth guard assembly worn in a person's mouth while a person wears the helmet on the person's head so that the male clip member of the first quick release engagement member is removably inserted into the receiving cavity of the mouth guard and the attachment means of the second quick release engagement member is removably attached to a portion of the helmet so that in the event of an impact force which causes the helmet to be removed from the person's head, depending on the location on the impact force, the first quick release engagement member will be released from the mouth guard and/or the second quick release engagement member will be released from the helmet so that the mouth guard remains in the person's mouth.

8. The mouth guard assembly in accordance with claim 7 wherein the second quick release engagement member further comprises a widened surface onto which a decoration can be placed.

9. The mouth guard assembly in accordance with claim 7 further comprising at least one breathing hole extending through said mouth guard.

10. The mouth guard assembly in accordance with claim 7 wherein the portion of the helmet to which the second quick release engagement member at the second end of the strap is attached is a face mask bar on the helmet.

* * * * *